US011426846B2

(12) United States Patent
Ge

(10) Patent No.: US 11,426,846 B2
(45) Date of Patent: Aug. 30, 2022

(54) QUICK-RELEASE SCREWDRIVER STRUCTURE

(71) Applicant: NINGBO HONY PLASTIC TECHNOLOGY CO., LTD, Zhejiang (CN)

(72) Inventor: Wenbing Ge, Zhejiang (CN)

(73) Assignee: NINGBO HONY PLASTIC TECHNOLOGY CO., LTD, Ningbo (CN)

( * ) Notice: Subject to any disclaimer, the term of this patent is extended or adjusted under 35 U.S.C. 154(b) by 226 days.

(21) Appl. No.: 16/845,031

(22) Filed: Apr. 9, 2020

(65) Prior Publication Data

US 2021/0316426 A1 Oct. 14, 2021

(51) Int. Cl.

| | |
|---|---|
| ***B25B 23/00*** | (2006.01) |
| ***B25G 3/12*** | (2006.01) |
| *B25B 23/10* | (2006.01) |
| *B25B 15/00* | (2006.01) |

(52) U.S. Cl.

CPC ..... *B25B 23/0035* (2013.01); *B25G 3/12* (2013.01); *B25B 15/004* (2013.01); *B25B 23/10* (2013.01); *B25B 23/108* (2013.01)

(58) Field of Classification Search

CPC . B25B 23/0035; B25B 15/008; B25B 15/004; B25B 23/103; B25B 23/101; B25B 23/10; B25G 3/12

USPC ..... 81/438

See application file for complete search history.

(56) References Cited

U.S. PATENT DOCUMENTS

| | | | | |
|---|---|---|---|---|
| 4,629,375 | A * | 12/1986 | Lieser | B25B 23/0035 408/239 R |
| 5,996,452 | A * | 12/1999 | Chiang | B25B 15/001 279/157 |
| 7,891,275 | B2 * | 2/2011 | Huang | B25B 23/0035 81/438 |
| 7,913,592 | B2 * | 3/2011 | Hu | B25B 23/12 81/438 |
| 8,550,471 | B2 * | 10/2013 | Huang | B23B 31/1071 279/30 |
| 8,622,401 | B2 * | 1/2014 | Puzio | B25B 23/0057 279/30 |
| 8,943,931 | B2 * | 2/2015 | Chiang | B25B 23/0035 81/429 |
| 9,561,581 | B2 * | 2/2017 | Chen | B25B 23/0035 |

(Continued)

FOREIGN PATENT DOCUMENTS

| | | | | |
|---|---|---|---|---|
| CA | 2496073 A1 | * | 8/2006 | B25B 15/001 |
| DE | 202009009213 | * | 10/2009 | |
| DE | 202011051006 | * | 1/2012 | |

*Primary Examiner* — Brian D Keller
*Assistant Examiner* — Jason Khalil Hawkins

(57) ABSTRACT

A quick-release screwdriver structure includes a tool holder and a tool head embedded in a head portion of the tool holder. A fixing seat is sleeved outside the tool head; an inner wall of the fixing seat is provided with a notch, and a bottom surface of the notch is an inclined surface; a steel ball connected to a release ring is installed in the notch, and the steel ball contacts the tool head; and a movement of the release ring will drive the steel ball to move along a longitudinal direction of the bottom surface of the notch so as to lock or release the tool head. A new locking assembly is designed to act on a surface of the tool head so as to achieve locking and disassembly of the tool head.

6 Claims, 2 Drawing Sheets

(56) References Cited

U.S. PATENT DOCUMENTS

| | | | | |
|---|---|---|---|---|
| 10,596,687 | B2 * | 3/2020 | Chuang | B25B 23/147 |
| 2007/0108706 | A1 * | 5/2007 | Cornwell | B25B 23/0035 279/143 |
| 2009/0224492 | A1 * | 9/2009 | Lin | B25B 15/001 279/82 |
| 2015/0102567 | A1 * | 4/2015 | Chan | B25B 23/0035 279/75 |
| 2016/0311091 | A1 * | 10/2016 | Wang | B25B 23/0035 |

* cited by examiner

QUICK-RELEASE SCREWDRIVER STRUCTURE

FIELD OF THE INVENTION

The present disclosure relates to a disassembly tool, and in particular, to a quick-release screwdriver structure.

BACKGROUND OF THE INVENTION

Screwdrivers (i.e., bolt drivers for daily use) are widely used for disassembling and assembling various workpieces. In order to facilitate the disassembly and assembly of workpieces of different sizes, many combined screwdrivers have appeared. In order to facilitate use for users and to avoid waste of resources, a screwdriver is usually provided with a plurality of different types and different sizes of screwdriver heads.

In order to realize the replaceable function of the screwdriver head, in the traditional structural design, a groove is provided on the surface of the screwdriver head, and then a locking means is provided on a screwdriver to act on the groove so as to lock the screwdriver head onto the screwdriver. When the screwdriver head needs to be replaced, the locking means is withdrawn from the groove so that the screwdriver head can be removed from the screwdriver. That is to say, screwdriver heads to which screwdrivers of the above type are adapted need to undergo further processing to form a groove structure so as to realize the installation of the screwdriver heads. This undoubtedly increases production costs of a product.

SUMMARY OF THE INVENTION

The technical problem to be solved by the present disclosure is to provide a quick-release screwdriver structure. A new locking assembly is designed to act on the surface of a tool head so as to achieve locking and disassembly of the tool head.

A technical solution adopted by the present disclosure in order to solve the above technical problem is a quick-release screwdriver structure, which includes a tool holder and a tool head embedded in a head portion of the tool holder. A fixing seat is sleeved outside the tool head; an inner wall of the fixing seat is provided with a notch, and a bottom surface of the notch is an inclined surface; a steel ball connected to a release ring is installed in the notch, and the steel ball contacts the tool head; and a movement of the release ring will drive the steel ball to move along a longitudinal direction of the bottom surface of the notch so as to lock or release the tool head.

In a further preferred solution of the present disclosure, the head portion of the tool holder is provided with a receiving groove for receiving a tail portion of the tool head, and a wall surface of the receiving groove is provided with an elongated hole; and the fixing seat is sleeved outside the tool holder and corresponds to the elongated hole.

In a further preferred solution of the present disclosure, the notch faces the elongated hole, and the steel ball installed in the notch is positioned in the elongated hole; and an outer peripheral surface of the steel ball passes through the elongated hole and contacts an outer wall of the tool head.

In a further preferred solution of the present disclosure, the release ring is sleeved outside the fixing seat and the head portion of the tool holder, and the release ring is axially movable with respect to the tool holder.

In a further preferred solution of the present disclosure, the steel ball is connected to a retainer, which is located in the release ring, and a movement of the retainer along an axial direction of the tool head will drive the steel ball to move along the longitudinal direction of the bottom surface of the notch.

In a further preferred solution of the present disclosure, a spring member is provided between the release ring and the tool holder, one end of the spring member being installed to the tool holder, the other end of the spring member abutting against the retainer, and the spring member is in a compressed state and applies a force on the retainer to move the retainer toward a head portion of the tool head.

In a further preferred solution of the present disclosure, the retainer is connected to the release ring, and a movement of the release ring drives the retainer to move synchronously.

In a further preferred solution of the present disclosure, the retainer is connected to the release ring by means of a first connecting member, which is an open annular structure.

In a further preferred solution of the present disclosure, two ends of the first connecting member are engaged within the release ring, and an outer periphery of the first connecting member is embedded into a wall surface of the release ring.

In a further preferred solution of the present disclosure, the fixing seat is engaged with the tool holder by means of a second connecting member, which is an open annular structure.

Compared with the prior art, the present disclosure has the advantage that a groove does not need to be formed in a tool head (i.e., screwdriver head, also referred to as screwdriver bit), but the locking and releasing of the tool head are realized by the cooperation of a fixing seat with a steel ball. More specifically, a fixing seat is sleeved outside a tool head, and a notch is formed on an inner wall of the fixing seat, a bottom surface of the notch being an inclined surface. The inclined surface cooperates with a steel ball to achieve wedged clamping to the tool head. A movement of a release ring drives the steel ball to move along a longitudinal direction of the bottom surface of the notch. When the steel ball moves to one end of the bottom surface of the notch, it will lock the tool head under the action of the bottom surface of the notch and fix the tool head. When the steel ball moves to the other end of the bottom surface of the notch, there will be enough space for the steel ball. The steel ball will no longer apply a force to the tool head, and the tool head will be released. At this time, the tool head can be removed and replaced. In the present disclosure, a new locking assembly is designed to act on a surface of a tool head so as to achieve locking and disassembly of the tool head.

BRIEF DESCRIPTION OF THE DRAWINGS

The present disclosure will be described further in detail below with reference to the accompanying drawings and preferred embodiments, but those skilled in the art will appreciate that these drawings are drawn only for the purpose of explaining the preferred embodiments, and therefore should not be taken as limitation to the scope of the present disclosure. In addition, unless specifically stated, the drawings are only schematic to represent components or constructions of the described objects conceptually and may be shown in an exaggerated manner, and the drawings are not necessarily drawn to scale.

DETAILED DESCRIPTION OF THE EMBODIMENTS

The present disclosure will be described in detail below with reference to the drawings.

In order to make the objective, technical solution, and advantages of the present disclosure much clearer, the present disclosure will be further described in detail below with reference to the drawings and embodiments. It should be understood that the embodiments described herein are only used to explain the present disclosure and are not intended to limit the present disclosure.

Figure 1:
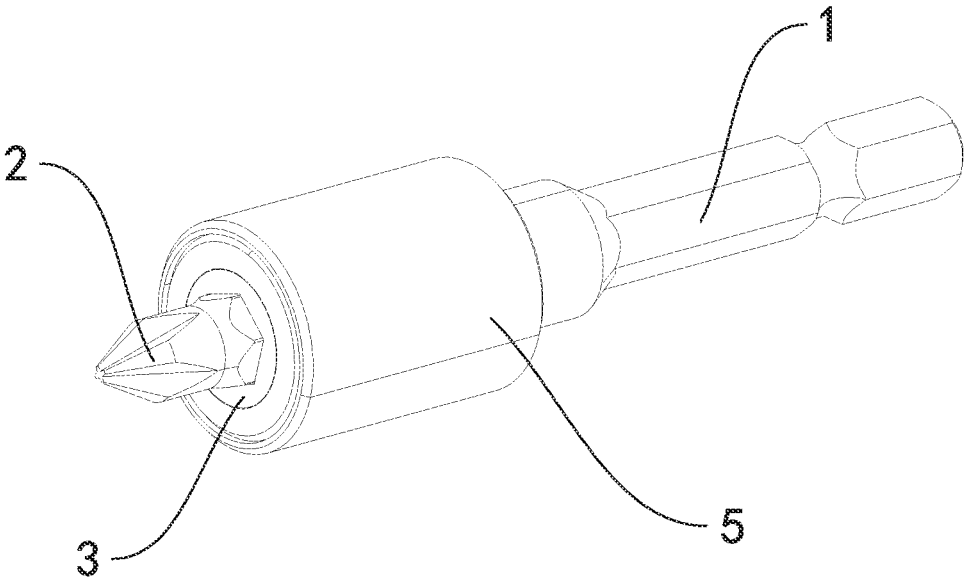
FIG. 1 is a schematic diagram showing a structure of the present disclosure.
Figure 2:
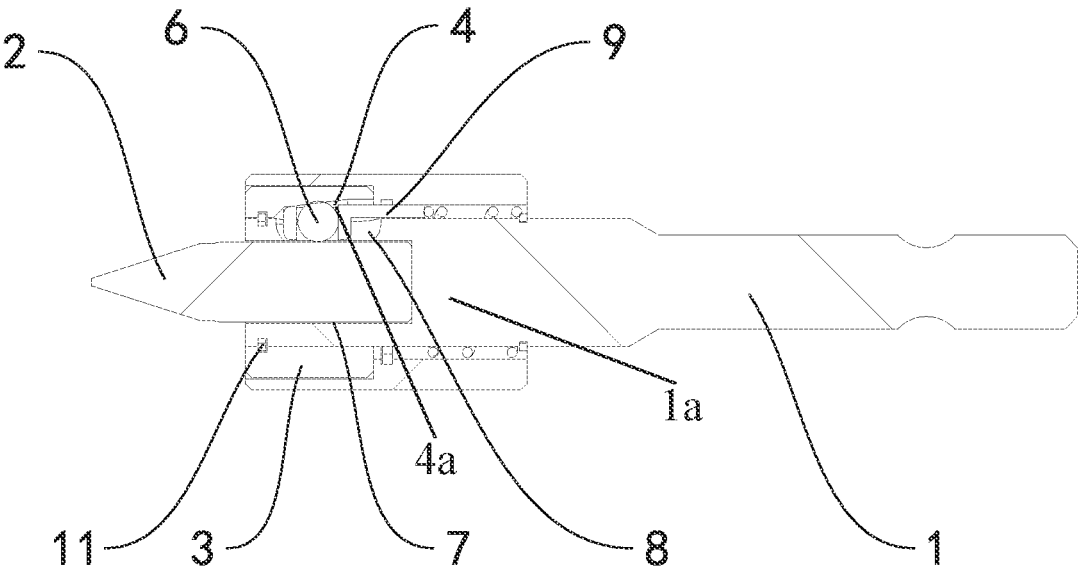
FIG. 2 is a sectional view of the present disclosure.
Figure 3:
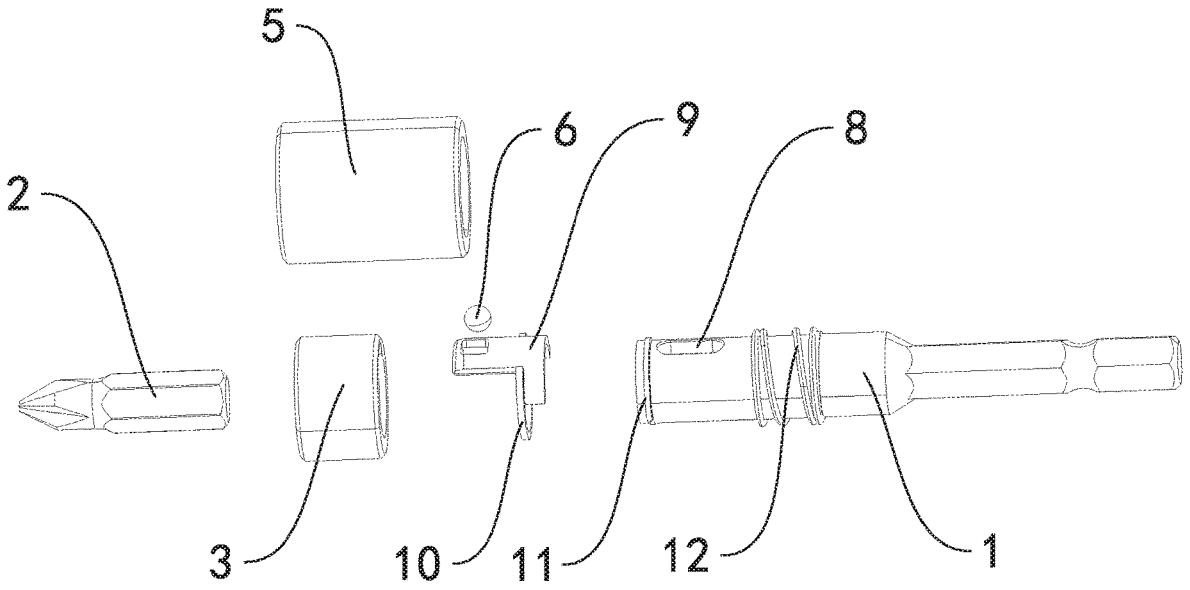
FIG. 3 is a schematic diagram showing an exploded structure of the present disclosure.

As shown in FIG. 1 to FIG. 3, a quick-release screwdriver structure includes a tool holder 1 and a tool head 2 embedded in a head portion 1*a* of the tool holder 1. A fixing seat 3 is sleeved outside the tool head 2, and an inner wall of the fixing seat 3 is provided with a notch 4. A bottom surface 4*a* of the notch 4 is an inclined surface, and a steel ball 6 connected to a release ring 5 is installed in the notch 4. The steel ball 6 contacts the tool head 2. A movement of the release ring 5 will drive the steel ball 6 to move along a longitudinal direction of the bottom surface 4*a* of the notch 4 so as to lock or release the tool head 2.

The head portion of the tool holder 1 is provided with a receiving groove 7 for receiving a tail portion of the tool head 2, and a wall surface of the receiving groove 7 is provided with an elongated hole 8. The fixing seat 3 is sleeved outside the tool holder 1 and corresponds to the elongated hole 8. The notch 4 faces the elongated hole 8, and the steel ball 6 installed in the notch 4 is positioned in the elongated hole 8. An outer peripheral surface of the steel ball 6 passes through the elongated hole 8 and contacts an outer wall of the tool head 2.

In the present disclosure, the receiving groove 7 is provided for installing the tool head 2 to ensure that the tool head 2 does not move radially after installation. The elongated hole 8 is provided for installing the steel ball 6. The steel ball 6 moves in the elongated hole 8, and an inner side of the steel ball 6 will pass through the elongated hole 8 to act on a surface of the tool head 2. The fixing seat 3 is provided outside the elongated hole, and the fixing seat 3 will act on the steel ball 6 to achieve wedged clamping in cooperation with the steel ball 6.

The release ring 5 is sleeved outside the fixing seat 3 and the head portion of the tool holder 1, and the release ring 5 is axially movable with respect to the tool holder 1. The release ring 5 is provided for facilitating operations for a user. By moving the release ring 5, the user can easily and quickly assemble and disassemble the tool head 2 to achieve quick release. In addition, the release ring 5 has a structure that encloses other internal parts, so that the present disclosure is concise and artistic in appearance.

The steel ball 6 is connected to a retainer 9, which is located in the release ring 5, and a movement of the retainer 9 along an axial direction of the tool head 2 will drive the steel ball 6 to move along the longitudinal direction of the bottom surface of the notch 4. In the present disclosure, the retainer 9 is provided for driving the steel ball 6 to move, and the structure and connection relationship of the retainer 9 define that the retainer 9 can be driven by the release ring 5 and moved only in the axial direction.

A spring member 12 is provided between the release ring 5 and the tool holder 1. One end of the spring member 12 is installed to the tool holder 1, and the other end of the spring member 12 abuts against the retainer 9. The spring member 12 is in a compressed state and applies a force on the retainer 9 to move the retainer 9 toward a head portion of the tool head 2. The retainer 9 is connected to the release ring 5, and a movement of the release ring 5 drives the retainer 9 to move synchronously. The spring member is used for applying a force on the release ring 5 and the steel ball 6 to ensure that the clamping of the steel ball 6 is stable and reliable. The spring member has a return function. After the release ring 5, the retainer 9, and the steel ball 6 are moved, the spring member drives them to return to their initial positions.

The retainer 9 is connected to the release ring 5 by means of a first connecting member 10, which is an open annular structure. In the present disclosure, the first connecting member 10 is used for connecting the retainer 9 and the release ring 5. Of course, an engineer in the art can adjust the structure of the first connecting member 10 according to the function, as long as the connection between the retainer 9 and the release ring 5 can be achieved.

Two ends of the first connecting member 10 are engaged within the release ring 5, and an outer periphery of the first connecting member 10 is embedded into a wall surface of the release ring 5. The configuration used in the present disclosure is preferred for the first connecting member 10.

The fixing seat 3 is engaged with the tool holder 1 by means of a second connecting member 11, which is an open annular structure. In the present disclosure, the second connecting member 11 is provided for connecting the fixing seat 3 and the tool holder 1. Of course, an engineer in the art can adjust the structure of the second connecting member 11 according to the function, as long as the connection between the fixing seat 3 and the tool holder 1 can be achieved.

An inclination angle of the bottom surface of the notch 4 in the present disclosure is 1 to 12 degrees, which is preferred for the technical solution of the present disclosure.

In the description of the present disclosure, it should be noted that the orientations or positional relationships indicated by terms "center", "upper", "lower", "left", "right", "vertical", "horizontal", "inner", "outer", etc. are based on the orientations or position relationships shown in the drawings. These terms are only for the convenience of describing the present disclosure and simplifying the description and do not indicate or imply that the device or element referred to must have a specific orientation and be constructed and operated in a specific orientation, and therefore cannot be understood as limitation to the present disclosure. In addition, terms "first", "second", and "third" are only for purposes of description and should not be interpreted as indicating or implying relative importance.

In the description of the present disclosure, it should be noted that, unless explicitly specified and defined otherwise, terms "installed", "connected to", and "connected" should be interpreted broadly. For example, it may be a fixed connection, a detachable connection, or an integral connection; it may be a mechanical connection or an electrical connection; and it may be a direct connection, an indirect connection by means of an intermediary, or an internal communication between two elements. For those of ordinary skill in the art, the specific meanings of the above terms in the present disclosure may be understood according to specific situations.

The present disclosure has been described in detail above. Specific examples are used herein to explain the principle and implementation manners of the present disclosure. The description of the above embodiments is only for understanding the present disclosure and the core idea. It should be noted that for those of ordinary skill in the art, several improvements and modifications can be made to the present disclosure without departing from the principle of the present disclosure, and these improvements and modifications also fall within the protection scope of the claims of the present disclosure.

The invention claimed is:

1. A quick-release screwdriver structure, comprising a tool holder and a tool head embedded in a head portion of the tool holder, wherein a fixing seat is sleeved outside the tool head; an inner wall of the fixing seat is provided with a notch, and a bottom surface of the notch is an inclined surface; a steel ball connected to a release ring is installed in the notch, and the steel ball contacts the tool head; and a movement of the release ring will drive the steel ball to move along a longitudinal direction of the bottom surface of the notch so as to lock or release the tool head;

wherein the head portion of the tool holder is provided with a receiving groove for receiving a tail portion of the tool head, and a wall surface of the receiving groove is provided with an elongated hole; and the fixing seat is sleeved outside the tool holder and corresponds to the elongated hole;

wherein the steel ball is connected to a retainer, which is located in the release ring, and a movement of the retainer along an axial direction of the tool head will drive the steel ball to move along the longitudinal direction of the bottom surface of the notch; and wherein a spring member is provided between the release ring and the tool holder, one end of the spring member being installed to the tool holder, the other end of the spring member abutting against the retainer, and the spring member is in a compressed state and applies a force on the retainer to move the retainer toward a head portion of the tool head.

2. The quick-release screwdriver structure according to claim 1, wherein the notch faces the elongated hole, and the steel ball installed in the notch is positioned in the elongated hole; and an outer peripheral surface of the steel ball passes through the elongated hole and contacts an outer wall of the tool head.

3. The quick-release screwdriver structure according to claim 1, wherein the release ring is sleeved outside the fixing seat and the head portion of the tool holder, and the release ring is axially movable with respect to the tool holder.

4. The quick-release screwdriver structure according to claim 1, wherein the retainer is connected to the release ring, and a movement of the release ring drives the retainer to move synchronously.

5. The quick-release screwdriver structure according to claim 4, wherein the retainer is connected to the release ring by means of a first connecting member, which is an open annular structure.

6. The quick-release screwdriver structure according to claim 1, wherein the fixing seat is engaged with the tool holder by means of a second connecting member, which is an open annular structure.

* * * * *